US006883309B2

(12) United States Patent
Jobson et al.

(10) Patent No.: US 6,883,309 B2
(45) Date of Patent: Apr. 26, 2005

(54) METHOD AND DEVICE FOR TREATMENT OF A GAS FLOW

(75) Inventors: Edward Jobson, Romelanda (SE); Björn Heed, Göteborg (SE)

(73) Assignees: AB Volvo, Göteborg (SE); Enklaven AB, Göteborg (SE)

( * ) Notice: Subject to any disclaimer, the term of this patent is extended or adjusted under 35 U.S.C. 154(b) by 0 days.

(21) Appl. No.: 10/249,391

(22) Filed: Apr. 4, 2003

(65) Prior Publication Data

US 2003/0221420 A1 Dec. 4, 2003
US 2005/0005595 A2 Dec. 4, 2003

Related U.S. Application Data

(63) Continuation of application No. PCT/SE01/02135, filed on Oct. 3, 2001, now abandoned.

(30) Foreign Application Priority Data

Oct. 4, 2000 (SE) ..... 0003578

(51) Int. Cl.[7] ..... F01N 3/00

(52) U.S. Cl. ..... 60/284; 60/274; 60/286; 60/297; 60/298; 60/300; 60/320; 422/173

(58) Field of Search ..... 60/274, 284, 286, 60/298, 300, 303, 311, 320, 297; 422/173, 174, 177, 180

(56) References Cited

U.S. PATENT DOCUMENTS 4,671,059 A 6/1987 Lawson
5,251,564 A * 10/1993 Rim et al. ..... 110/344
5,785,030 A * 7/1998 Paas ..... 60/278
5,916,129 A * 6/1999 Modica et al. ..... 60/274
5,983,628 A * 11/1999 Borroni-Bird et al. ..... 60/274
6,178,744 B1 * 1/2001 Perset ..... 60/288
6,347,511 B1 * 2/2002 Haines ..... 60/274

FOREIGN PATENT DOCUMENTS

EP 0504719 A1 9/1992
EP 0668437 A1 8/1995
WO WO 9116529 A1 10/1991
WO WO 9604509 A1 2/1996
WO WO 9627078 A1 9/1996

* cited by examiner

*Primary Examiner*—Binh Q. Tran
(74) *Attorney, Agent, or Firm*—Novak Druce & Quigg, LLP

(57) ABSTRACT

Method and apparatus for treating a gas flow including guiding the gas flow through a gas treatment unit (18) adapted for filtering particles in the gas flow, and eliminating the particles in the gas treatment unit (18). Particles are filtered from the gas flow by means of accumulating the particles in, or in connection with, a number of ducts (21) forming part of the gas treatment unit (21) during passage of the gas flow through the gas treatment unit (18). The temperature of the gas flow is controlled along the ducts (21) to a value that provides combustion of the particles, and eliminates the filtered particles in the gas treatment unit (18) by means of combustion in the ducts (21). An improved treatment of a gas flow is provided, in particular in connection with exhaust gas purification in a diesel engine, for eliminating particles in its exhaust gases.

20 Claims, 4 Drawing Sheets

METHOD AND DEVICE FOR TREATMENT OF A GAS FLOW

CROSS REFERENCE TO RELATED APPLICATIONS

This application is a continuation patent application of International Application No. PCT/SE01/02135 filed Oct. 3, 2001 which was published in English pursuant to Article 21(2) of the Patent Cooperation Treaty, and which claims priority to Swedish Application No. 0003578-2 filed Oct. 4, 2000. Both applications are expressly incorporated herein by reference in their entireties.

BACKGROUND OF INVENTION

1. Technical Field

The present invention relates to methods and devices for the treatment of a gas flows that include guiding the gas flow through a gas treatment unit adapted for filtering particles from the gas flow and eliminating those particles at the gas treatment unit. More particularly, the invention is intended to be used for separating and eliminating particles from the exhaust gases of a combustion engine. The invention also relates to a device for accomplishing such a treatment of a gas flow.

2. Background of the Invention

In the field of vehicles that are operated by combustion engines, there is a general demand for low emissions of harmful substances in the exhaust gases from the engine. The substances are primarily constituted by pollutants in the form of oxides of nitrogen ($NO_x$), hydrocarbon compounds (HC) and carbon monoxide (CO). As regards petrol engines, the exhaust gases are normally purified by means of an exhaust catalyst that forms part of the exhaust system and through which the exhaust gases are guided. In what is referred to as a three-way catalyst, which is previously known, the major part of the above-mentioned harmful compounds is eliminated by means of known catalytic reactions. In order to optimize the function of the catalyst so that it provides an optimal degree of purification for $NO_x$, HC, and CO, the engine is in most operating conditions operated by a stoichiometric air/fuel mixture; that is, a mixture where (lambda)=1.

Furthermore, in the field of vehicles that are operated by means of a combustion engine, there is a demand for low emissions of harmful substances in the form of solid particles, and primarily in the form of carbon particles that are present in the engine exhaust gases. This demand or requirement is, for example, valid in connection with diesel engines. In order to eliminate such particles, it is previously known to utilize various types of carbon filters. For example, today ceramic filters are utilized that are constructed with a porous wall structure by means of which particles in the exhaust gases can be deposited in the pores of the wall structure.

One disadvantage of such ceramic filters is that they must be regenerated at regular intervals; that is, particles that have been accumulated in the filter must be removed from the wall structure after some time of use. In this case, the regeneration suitably takes place by means of combustion of the particles at a certain increased temperature, normally 400–500 degrees C., which for example can be obtained by means of a special electric heater. After this measure, the filter can once again be utilized for accumulating particles.

One particular type of particle filter is the so-called "city filter," by means of which the necessary temperature can be obtained so that the combustion of particles can take place. Although this type of filter functions satisfactorily in principle, it has certain disadvantages, such as, because of its construction, it imposes a comparatively high fall in pressure thereacross. Furthermore, it has a comparatively low filtration capacity because it is based on surface filtration across a comparatively small surface. Furthermore, the pressure loss over such a filter increases over the years, which is due to the fact that ashes gradually obstruct the filter. In addition, carbon can be accumulated during operation at low temperatures. When the vehicle subsequently increases the load, spontaneous ignition may occur and which can permanently damage the filter.

There are also other types of filters that are based on the fact that particles are gradually accumulated in a filter unit, which in that case is replaced after some time of use.

SUMMARY OF INVENTION

An objective of the present invention is to provide an improved treatment for gas flows; and in particular, during exhaust gas purification in the form of particle filtration in connection with a combustion engine, and by means of which the above-mentioned disadvantages of known systems are solved in an effective manner. This is accomplished by means of a method that includes filtering particles from a gas flow by accumulating the particles in, or in connection with, a number of ducts forming part of the gas treatment unit during passage of the gas flow through the gas treatment unit. The temperature of the gas flow along the ducts is controlled to a value that provides combustion of the particles, and ultimately the filtered particles are eliminated at the gas treatment unit by means of combustion in the ducts. The objective is also accomplished by means of a device in which the control of the temperature of the gas flow takes place by means of a particular control of the composition of the gas flow.

In at least one embodiment, the invention takes the form of a method that includes guiding a gas flow through a gas treatment unit that is adapted for filtering particles in the gas flow, and for eliminating the particles in the gas treatment unit. The invention is further characterized in that the filtering particles from the gas flow is by accumulating the particles in, or in connection with, a number of ducts forming part of the gas treatment unit during passage of the gas flow through the gas treatment unit. The temperature of the gas flow is controlled along the ducts to a value that provides combustion of the particles, which is how they are eliminated, or at least reduced. The invention also relates to the devices and arrangements utilized for accomplishing such a treatment of a gas flow.

The invention is based on the fact that particles are accumulated in corrugations in the gas treatment unit and are kept in place while combustion of the particles takes place. Furthermore, the invention is provided with a heat exchanging function by means of which combustion of the particles is controlled to take place at a sufficiently high temperature, which in turn is provided in an energy-saving manner. During the combustion, almost exclusively carbon dioxide is formed. Thus, according to the invention, a combined method for interchange of heat and filtration of particles is provided.

In this connection, the term particles is used in order to describe undesired emissions of solid particles, primarily in the form of carbon, and which normally form part of the exhaust gases from a diesel engine or a corresponding engine which is adapted for operation with a surplus of oxygen.

BRIEF DESCRIPTION OF DRAWINGS

The invention will be further described in the following, with reference to a preferred embodiment, and to the annexed drawings, in which.

DETAILED DESCRIPTION

Figure 1:
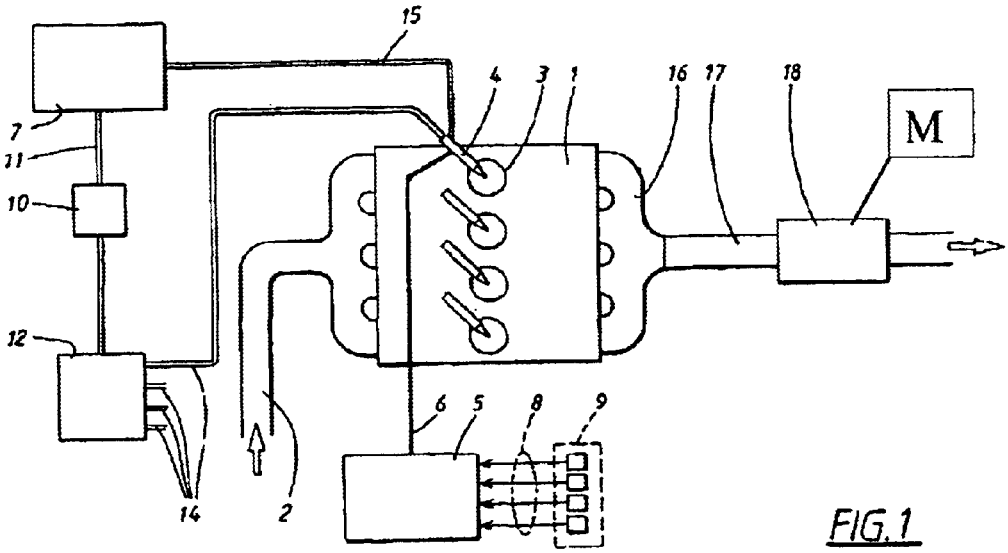
FIG. 1 is a simplified schematic.and principal view showing an engine arrangement in which the present invention can be utilized.

FIG. 1 shows a schematic and simplified view of an arrangement of a gas treatment process configured according to the teachings of the present invention. According to a preferred embodiment, the invention is arranged in connection with a combustion engine 1, exemplarily in the form of a diesel engine. However, the invention is not limited to utilizations in connection with only diesel engines, but may be utilized for all types of combustion processes where an elimination of carbon particles in a gas flow is desirable; as an example, in connection with other types of combustion engines that at least periodically are operated using a surplus of oxygen. One specific example of an engine type where the invention can be utilized is a so-called DI engine; that is, an engine of the direct-injected, Otto cycle engine type, and which is characterized in that it, in certain operating conditions, is operated by a large surplus of oxygen in the air/fuel mixture to the engine. During operation of a combustion engine of, for example, the diesel engine type or the DI engine type, exhaust gases are generated which contain carbon and other solid particles. Resultantly, there is a demand for purification of the exhaust gases in order to eliminate the particles.

The diesel engine 1, according to FIG. 1, is supplied in a conventional manner with inflowing air via an air inlet 2. Furthermore, the engine 1 is provided with a number of cylinders 3 and a corresponding number of fuel injectors 4. The respective injectors 4 are connected to a central control unit 5 via a corresponding electrical connection 6. The control unit 5 is preferably computer based and is adapted to control the fuel supply to each injector 4 with fuel from a fuel tank 7, in a known manner that enables the air/fuel mixture to be adjusted in every given moment with respect to supply to the engine 1 via the respective injector 4. In this regard, the control of the air/fuel mixture to the engine 1 is adjusted to the prevailing operating conditions.

The control of the engine 1 takes place in an essentially known manner depending on various parameters that reflect the operating condition of the engine 1 and the incorporating vehicle. For example, the control of the engine can take place depending on the prevailing degree of throttle application, the engine speed, the amount of supplied air to the engine and the temperature of, for example, the cooling medium and the fuel of the engine. To this end, the control unit 5 is provided with a number of measuring signals 8. The measuring signals 8 correspond to incoming parameters from a corresponding number of detectors, which symbolically are indicated by the reference numeral 9 in FIG. 1.

The method for controlling a diesel engine, for instance from the perspective of fuel supply that is dependent on the prevailing load and engine speed, takes place in a traditional manner and which is well known and understood by those persons skilled in this art, and is therefore not described in further detail. It can be mentioned, however, that fuel is supplied from the fuel tank 7 and through a fuel filter 10 via a first fuel line 11. After filtering the fuel, it is guided further on to a fuel pump 12 via a second fuel line 13. From the fuel pump 12, the fuel is supplied to each injector 3 via corresponding additional fuel lines 14. The system also includes a return line 15 for unused fuel from the respective injector 3 and back to the fuel tank 4. As is known, the fuel pump 12 is utilized for generating the necessary fuel pressures required during injection and combustion in the respective cylinder 3.

During operation of the engine 1, its exhaust gases are guided out from the cylinders 3 via a branch pipe 16 and further on to an exhaust pipe 17 that is connected to the branch pipe 16. In accordance with the invention, a unit 18 is provided further downstream, along the exhaust pipe 17, for the treatment of exhaust gases, and in the illustrated case, in the form of exhaust gases from the engine 1. The construction and the function of this exhaust gas treatment unit 18 will be described below in greater detail with reference to FIGS. 2, 3 and 4. From the exhaust gas treatment unit 18, the exhaust gases are guided further out into the surrounding atmosphere as shown schematically by the exit arrow at the top end of FIG. 1.

Figure 2:
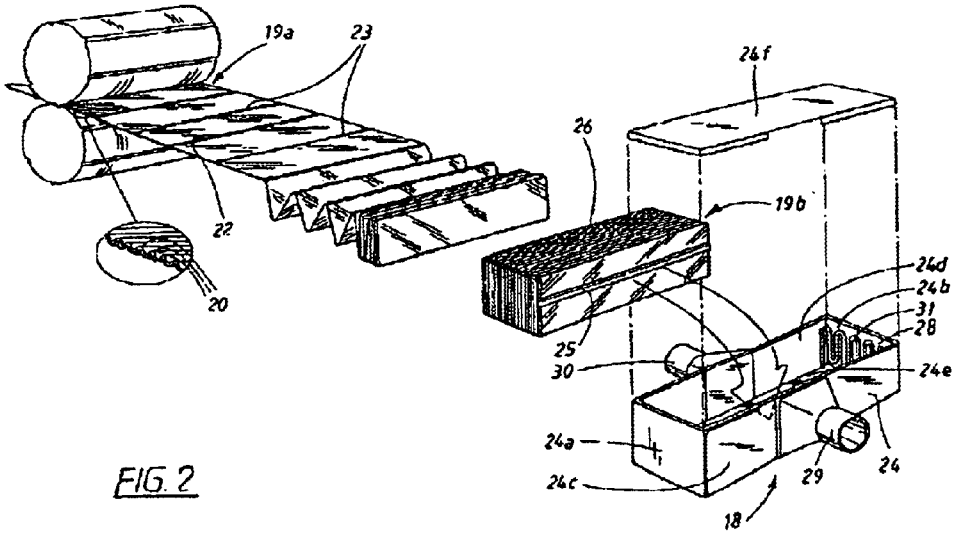
FIG. 2 is a perspective view showing an arrangement and process for constructing a special exhaust gas treatment unit configured according to the teachings of the present invention.

As shown in FIG. 2, the exhaust gas treatment unit 18 comprises (includes) a strip 19*a* of metal, which by means of a suitable method (e.g. pressing or rolling) has been formed with corrugations 20 which extend in a predetermined angle in relation to a longitudinal direction of the strip 19*a*. This angle can measure between 0–90 degrees, and is suitably found within the interval of 30–60 degrees. The strip 19*a* is repeatedly folded in a zigzag form so that it forms a strip package 19*b*. In this manner, an arrangement is formed where the above-mentioned corrugations 20 run crosswise in relation to each other in adjacent layers in the strip package 19*b*. Moreover, the corrugations 20 function as spacers, by means of which several ducts or slits 21 (see in particular FIG. 4) are formed which are separated from each other and through which a gas flow is intended to flow. In the illustration, the flow is composed of exhaust gases from the engine 1.

The flow pattern in the ducts 21 is of such a kind that the flow in the duct is constantly mixed and has satisfactory contact with the walls of the ducts 21. Moreover, according to the depiction of FIG. 2, the corrugations 20 can, in order to facilitate the folding of the strip, be interrupted at regular intervals in order to be replaced with folding notches 22, 23 that run at right angles to the strip 19*a*.

Furthermore, the strip 19*a* is enclosed in a heat insulated external container 24, though the insulation is not shown in the drawings. The external container 24 is essentially rectangular and comprises two end walls 24*a*, 24*b*, two sidewalls 24*c*, 24*d*, a lower wall 24*e*, and an upper wall 24*f*. The strip package 19*b* is sealed against the two sides 25, 26 that are arranged in parallel with the flow direction of the gas flow through the strip package. The end sections of the strip package, however, are not sealed, but end in two return chambers 27, 28, as is particularly apparent from FIG. 3.

Furthermore, the external container 24 comprises an inlet that is provided with a sleeve 29 for connection of inflowing gas and an outlet that is provided with an additional sleeve 30 for connection of outflowing gas. By means of the folding of the strip, connection takes place in a simple manner from the side of the package to all ducts on one side of the strip package 19*b*, which is due to the fact that the two nozzles 19, 30 connect to a respective side of the strip. The inlet and outlet, respectively, of the external container 24 are preferably situated essentially centrally on the respective sidewall 24*c*, 24*d*. This corresponds to the fact that the inlet and the outlet, respectively, are positioned at essentially the same distance from the respective end wall, 24*a*, 24*b*. By means of this division of the gas flow into two flows, each with only half the speed, the pressure loss decreases considerably.

According to the present invention, the strip package 19*b* is utilized for filtering and eliminating particles, primarily in the form of carbon, from the exhaust gases emitted from the engine 1, and which are guided into the exhaust gas treatment unit 18 via the exhaust pipe 17. More precisely, the strip package 19*b* is formed in such manner that particles in this exhaust gas flow will be accumulated in the above-mentioned corrugations 20, which in this way function as separation elements by means of which the particles can be separated from the gas flow. The invention is based, at least in part, on the fact that the corrugations are utilized for collecting the particles, and the particles then remain in place along the corrugations 20 for a sufficiently long time that they are eventually combusted. This accumulation of particles on the strip package 19*b* takes place because the exhaust gas is repeatedly relinked to a new direction of motion by means of which the particles will show a tendency to fall out of the exhaust gas stream and adhere to the surface of the strip package 19*b*, for instance, along the corrugations 20. This accumulating function of the exhaust gas treatment unit 18 is obtained on the one hand by means of the fact that the particles, due to their comparatively high density, have a tendency to move in a more linear manner than the gas. Also, the particles that come close to the surface of the wall will be attracted by it. This latter feature can be produced or enhanced by means of electrical forces and so-called van der Waals forces. Furthermore, the turbulent flow that the corrugations cause results in the gas being constantly mixed so that all particles eventually come close to the wall.

Furthermore, according to what will be described in detail below, an increased temperature (normally to approximately 400–500 degrees C.) can be generated in the strip package 19*b* during operation of the engine 1. This can take place either by means of a special control of the composition of the exhaust gases (which in turn can take place by injecting for example hydrocarbon compounds in the exhaust flow, or by means of a special control of the engine 1) or by means of a special heater element or by means of a heat exchanging function at the strip package 19*b* (or by means of a combination of these measures). Ultimately, the result according to the present invention is that the particles that have been accumulated in the corrugations 20 will be combusted either continuously or intermittently when the temperature is sufficiently high. During the combustion, the particles are eliminated while carbon dioxide is formed.

It can be noted that a surplus of oxygen is necessary in the exhaust gas while the accumulated particles are combusted. Thus, the invention can be utilized for engines which are adapted for operation with a surplus of oxygen (i.e. (lambda) >1), but also for engines adapted for operation with an equilibrium of oxygen ((lambda)=1) or a deficit of oxygen ((lambda)=1). In the latter cases, combustion of carbon and other particles can suitably take place during intermittent occasions with a surplus of oxygen.

The invention can be utilized with various methods for filtration and separation of carbon particles from the gas flow in question. Below, some examples of methods for carbon separation will be described. According to a first embodiment, the invention can be utilized for providing a filtering process of the surface filtering type in which particles are accumulated in a coating or a layer; in the illustrated case, on the surface of the strip package 19*b*. In order to provide this function, a porous catalytic coating or wall is preferably utilized, suitably in the form of a glass fiber mat or similar material, that can be laid out between the folds in the strip package 19*b*. The mat can be provided along the entire extension of the strip package 19*b*, or at certain selected parts of the strip package 19*b*. Preferably the mat is provided between the surfaces of the strip package 19*b* (see FIG. 4), but without being in contact with the surfaces of the strip package 19*b*. In this configuration, the gas flow is influenced to pass through the mat. If the mat, for example, is laid out close to the respective return chamber 27, 28, it will be possible to control the temperature by means of a suitable engine control as will be described in greater detail below. In this manner, the combustion of particles can be controlled. A similar function is obtained if the strip package 19*b* is provided with a fiber cloth, a net or some similar porous coat that is capable of absorbing particles.

The basic principle of utilizing the above-mentioned mat is that the particles that are present in the gas flow will be accumulated and kept in the mat so that they can be combusted. According to a variant of this embodiment, the mat can be formed of catalytic material, which improves the filtering effect.

An alternative manner of separating particles is by providing the exhaust gas treatment unit 18 with a porous body that can be of a suitable material such as foam, ceramic or a sand bed, and which can be situated at a suitable place within its container 24. Such a type of filtering is of the deep filtering type, in contrast to filtering methods where particles are accumulated in a coat or a layer, which in that case is termed surface filtering according to what has been explained above.

One additional manner of separating particles in the exhaust gas treatment unit 18 according to the invention is to use the principle of electric filtering, which is particularly suitable for filtration of comparatively small particles, more precisely of the order of <1 um. An electric filter is based on the utilization of a special ionization unit (not shown in the drawings) which in the present case can be suitably provided in connection with the exhaust gas treatment unit 18, for example before (upstream) the strip package 19*b*. Such ionization units are generally known and are utilized for charging particles in a passing gas by means of ionization of the gas. Then, the charged particles can be influenced to fall out and be accumulated on earthed plates. In that case, according to a suitable form of the invention, the earthed plates are constituted by the actual strip package 19*b*, which to this end is connected to a ground point (not shown). This variant of the invention, however, is not limited to the ionization unit being situated upstream of the strip package 19*b*. Alternative placements, for instance in one of the above-mentioned return chambers 27, 28, can also be suitable for such an ionization unit. An advantage of the ionization of the gas in one of the return chambers 27, 28 (or both) is that the main part of the carbon particles in this way falls out close to the respective return chamber where the temperature is favorable for combustion of the particles. By placing the ionization unit before the strip package 19*b*, only one single, small ionization unit is required, while two such units are required if ionization shall take place in the two return chambers 27, 28.

In order to facilitate filtering, an aggregation of small particles to larger particles can take place. This takes place by utilizing turbulence in the exhaust gas treatment unit 18 caused by the corrugations in the separation unit. Particles collide with each other and with the walls, by means of which electricity is transmitted. In this manner, attractive electric fields are formed. These large particles are subsequently filtered out by means of one of the above-mentioned methods.

As mentioned above, a basic principle of the invention is that the particles that have been separated by means of the strip package 19*b* also can be eliminated in the exhaust gas treatment unit 18. Preferably, this takes place by means of combustion in the strip package 19*b*. In that case, the basic principle is that the invention is utilized in connection with such a control of the engine 1 that a temperature, which is sufficiently high for combustion of the particles, is generated in the exhaust gases, and thus also in the strip package 19*b*. On account of this, there is a demand for accurate temperature control of the exhaust gases. To this end, a basic principle of the invention is that an adjustment of the temperature of the prevailing gas flow takes place so that the temperature of active parts of the exhaust gas treatment unit 18 will be above a predetermined temperature limit at which combustion of particles can take place. As regards the heat exchanging function, it can be established that various parts of the exhaust gas treatment unit 18 normally have varying temperatures. More precisely, the temperature in the respective return chamber and its vicinity is normally higher than in the parts of the exhaust gas treatment unit 18 where the gas is guided in and out. The temperature limit at which combustion takes place is normally approximately 400–500 degrees C. In order to achieve an increase of the temperature of the exhaust gas treatment unit 18, exothermic reactions, which occur as a consequence of the energy content in the exhaust gases, are utilized. Furthermore, an increase of the temperature can be obtained as a result of a change of the energy content in the exhaust gases by means of a suitable engine control, wherein the control unit 5 is utilized for this control. More precisely, this can be achieved by means of, for example, a modification of the time for the injection and the ignition in the respective cylinder, or by means of additional injection of fuel during the exhaust stroke of the engine. An additional manner of providing an increase of temperature is by injecting air from an external source (not shown) into the exhaust gas treatment unit 18 during rich operation of the engine. An additional manner of providing an increase of temperature is by controlling the cylinders individually, wherein the exhaust gases from one or some of the cylinders 3 are operated in a rich manner, whereas the rest of the cylinders are operated in a lean manner. This can result in a powerful exothermic reaction and a heat release.

The combustion of particles is facilitated if the strip package 19*b* is coated with some type of oxidation catalyst, or some other suitable type of catalyst, which provides catalytic oxidation of predetermined gas components; for example, in the form of hydrocarbon compounds in the exhaust gases. In this way, the presence of such hydrocarbon compounds can be influenced by controlling the engine so that large contents of uncombusted hydrocarbons are generated in the exhaust gas. By means of oxidation of these hydrocarbons in the exhaust gas treatment unit 18, a drastic increase in temperature in the exhaust gas treatment unit is obtained, which in turn results in an effective particle combustion.

In case of the invention being utilized in diesel engines, it is not always suitable to operate the engine in a rich manner. In such a case, an increase in temperature can instead be obtained by injecting fuel directly into the exhaust gases after the engine or in connection with the exhaust stroke in the engine. In one such case, fuel (or some other reducing agent) can be dosed (input) both before the exhaust gas treatment unit 18, for example in one of the return chambers 27, 28, and directly into the exhaust gas treatment unit 18 between its inlet and the return chambers 27, 28 (or between the return chambers and their outlets).

Regardless of which method for heating the exhaust gases is utilized, it can be established that the invention is based at least in part on the fact that the engine 1 can be operated so that a sufficiently high temperature is generated in the strip package 19*b*, which in turn results in a combustion of the particles that have been accumulated in the corrugations 20. In this connection, the strip package 19*b* functions as a heat exchanger, wherein the exhaust gas flow takes place during interchange of heat between incoming and outgoing flows. The interchange of heat, according to the invention, is based on the fact that a sufficiently high temperature can be obtained with a comparatively low consumption of energy. In this way, this temperature exceeds a level at which the reaction of combustion can take place. More precisely, the interchange of heat can be utilized in order to provide a higher exhaust gas temperature than the exhaust gases have before they are guided into the exhaust gas treatment unit 18. Furthermore, the invention is based on the fact that the particles are accumulated and kept in the exhaust gas treatment unit 18 for a sufficiently long time in order for combustion of the particles to take place at a temperature in the order of 400–500 degrees C.

Figure 3:
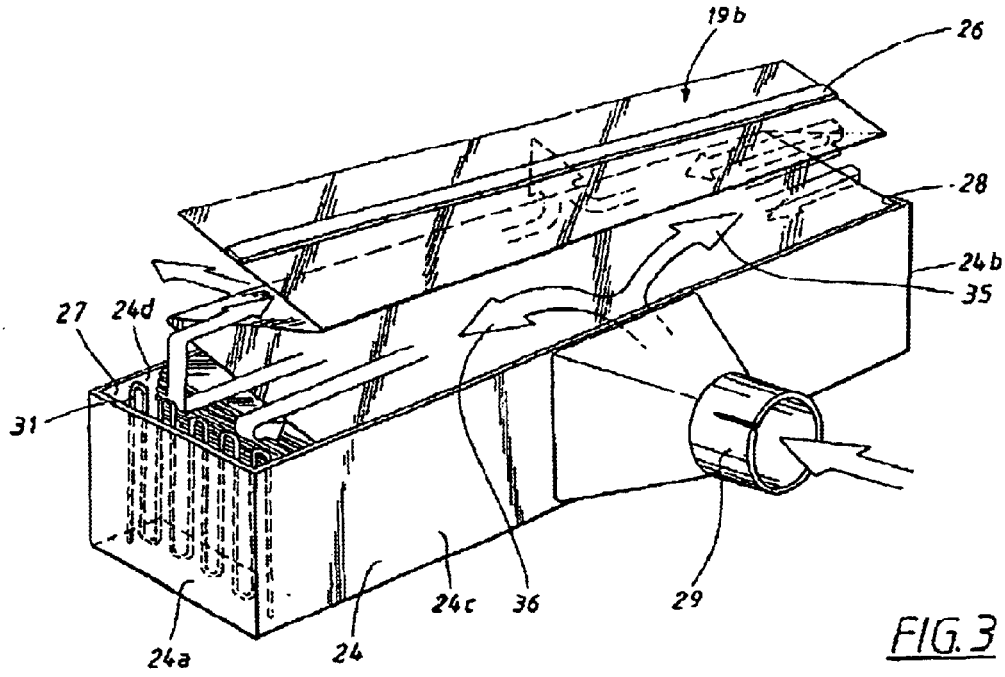
FIG. 3 is a partially exploded perspective view showing an exemplary exhaust gas treatment unit slightly enlarged in comparison with the depiction of FIG. 2.
Figure 4:
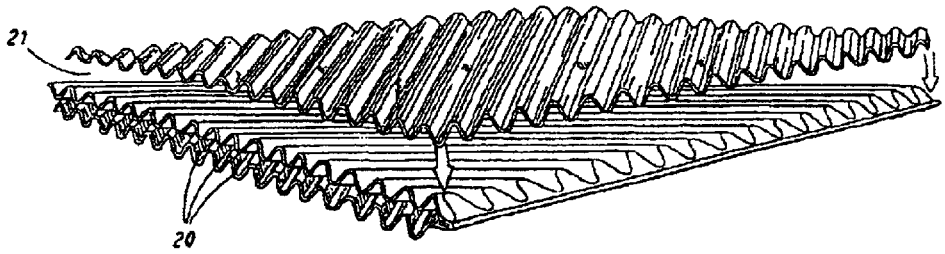
FIG. 4 is a perspective, detailed view of constituent components of the exhaust gas treatment unit.

An additional possible manner of increasing the temperature of the gas flow is by means of externally supplied heat. According to what is depicted in FIGS. 2 and 3, this can, for example, take place by means of a special heater element 31. In that case, such a heater element 31 is suitably provided in each of the return chambers 27, 28. The heater element 31 is formed of electrical heating conductors that are adapted for generating heat during connection to a separate (not shown) voltage source. It can in particular be noted that even a comparatively small supply of heat in the return chambers by means of the heater element 31 results in an efficient increase in temperature. Thus, by means of a comparatively small supply of heat, an increase in temperature is obtained which is sufficient for combusting the carbon particles that have been filtered out.

The invention is not limited for utilization with the above-mentioned heater element. Alternatively, heat can be supplied externally by such means as a gas or oil burner, or an external fuel injection. According to an additional alternative, a heating function can be provided by means of a supply of hot air (or some other suitable gas) from an external source.

Furthermore, the invention is not limited for utilization with an external supply of heat. Thus, such a supply can in principle be excluded for those applications in which a sufficiently high temperature can be generated without any externally supplied heat.

Thus, it can be established that the invention can be arranged in such a manner that an increased temperature is generated by controlling the composition of the exhaust gases by, for example, selecting the concentration of various substances or gas components in the exhaust gas flow which in turn results in an increase in temperature which is necessary for elimination of particles by means of combustion. As mentioned above, this can be provided by means of an engine control which is adapted to its purpose (which in turn can be utilized for generating predetermined levels of, for example, hydrocarbon compounds in the exhaust gas flow), by means of injection of, for example, hydrocarbon compounds directly into the exhaust gases or by injecting air into the exhaust gases. Alternatively, according to what has been mentioned above, the invention can also be arranged in such manner that an increase in temperature is obtained by means of externally supplied heat.

During operation of the engine 1, exhaust gases are supplied through the exhaust gas treatment unit 18. In this case, the exhaust gases are guided via the inlet 29 (see FIGS. 2 and 3) and are divided into two partial flows 35, 36. The flows 35, 36, are guided through the ducts on one side of the strip package 19*b* and in the direction of the respective return chamber 27, 28. Initially, the supplied exhaust gases will be comparatively cold, but are gradually heated towards the reaction temperature at which combustion of particles can take place according to what has been explained above. At the same time as hot exhaust gases are guided towards the outlet 30 of the exhaust gas treatment unit 18, additional exhaust gases enter via the inlet 29. In this case, heat will be transmitted from the outgoing gas flow to the incoming gas flow. By means of a satisfactory heat exchange between the outgoing and the incoming gas flows, the local temperatures of the flows can be influenced to lie close to each other. For this reason, only a small additional supply of heat in the return chambers 27, 28 is required in order to, for example, increase the temperature of the gas flow. At the same time as the gas flow is heat-treated to the correct temperature in the exhaust gas treatment unit 18, it is guided over the corrugations 20 which constitute a filter, wherein the particles are accumulated and finally combusted as a consequence of the increased temperature.

The invention discloses an effective heat exchanging function, which in turn is utilized for facilitating the adjustment of the temperature of the exhaust gas treatment unit, which in turn results in a combustion of particles in the exhaust gases which functions optimally. In particular, the invention provides that a gas flow can be treated for filtration and elimination of particles at a certain temperature with a low heat consumption. During heating of the gas flow, a certain amount of heat (for a given gas volume) is consumed, which later on can be recovered for heating a new inflowing gas volume. This results in a heat exchange effect that requires considerably less energy than traditional heating systems that, for example, are based on separate heater elements, for instance, of the electric type.

In the embodiments of the invention that include coatings of catalytic material, the strip package 19*b* can be formed in such manner that it is coated with a catalytic material which provides a function that corresponds to a three-way catalyst, for instance, one which is utilized for catalytic elimination of undesired compounds in the form of nitric oxides, carbon monoxide and hydrocarbon compounds in the exhaust gases from the engine 1. Techniques for coating surfaces with thin coatings of catalytic material are previously known such as when manufacturing conventional car catalysts.

Moreover, the strip package 19*b* can be provided with a $NO_x$ reducing coating; that is, a coating that provides a function which corresponds to a nitrogen oxide adsorbent (also called $NO_x$ adsorbent). According to what is previously known, a $NO_x$ adsorbent can in a known manner be utilized for reducing $NO_x$ compounds in the exhaust gases of the engine 1. Accordingly, the exhaust gas treatment unit 18 can constitute an integrated component that is utilized as a particle filter and which also comprises both $NO_x$ reducing material (which thus constitutes a so-called $NO_x$ adsorbent) and, where appropriate, material that provides the function of a conventional three-way catalyst. In this manner, a combined effect against $NO_x$ compounds and hydrocarbons, as well as particles, is provided. $NO_x$ reduction is provided in the stoichiometric case by means of the three-way catalyst, and in the lean case by means of the $NO_x$ adsorbent.

The invention is not limited to this type of design in which an integrated unit is provided that simultaneously functions as three-way catalyst and a $NO_x$ adsorbent, but may also be based on the fact that the exhaust gas treatment unit comprises, for example, $NO_x$ adsorbing material and is connected to a separate unit in the form of a three-way catalyst. According to an additional alternative, the exhaust gas treatment unit can be formed without either a $NO_x$ adsorbent or a three-way catalyst, wherein both of these functions in that case can be provided by means of separate units along the engines exhaust pipe. Whichever specific design is selected in the present application depends, for example, on how the space in the present vehicle can be utilized. Other factors which determine the selection of design are the demands for an acceptable heating effect, pressure loss and loss of heat and factors regarding production and cost.

According to an alternative embodiment, the engine 1 can be connected to a pre-catalyst (not shown) of the three-way type. Suitably, the pre-catalyst is provided with a comparatively low oxygen storage capacity and is provided upstream of the exhaust gas treatment unit 18 and is preferably comparatively close to the exhaust manifold 16. In that case, such a pre-catalyst is particularly adapted for rapid heating during cold starts of the engine 1; that is, so that its catalytic coating rapidly becomes active. This provides a considerable elimination of HC, CO, and $NO_x$ compounds in the exhaust gases, particularly during low idle flows. Due to the fact that the flowing exhaust gases can be heated rapidly by means of the pre-catalyst, a comparatively rapid heating is also provided for the subsequent exhaust gas treatment unit 18; that is, a comparatively short time passes until the exhaust gas treatment unit 18 has been heated to a temperature at which it is capable of combusting the harmful particles which are separated by means of the strip package 19*b*. This results in efficient exhaust purification for the engine 1, particularly during cold starts.

In some cases, for example for protecting the material in the exhaust gas treatment unit 18 from too high temperatures which can occur during some operating conditions, cooling of the unit may come into question. If so, the temperature can be reduced in a number of ways, for example, by means of external cooling. More precisely, this could be implemented by supplying, for example water or air, which would be supplied through the exhaust gas treatment unit 18. An additional manner is to utilize (not shown) cooling flanges in the exhaust gas treatment unit 18. In that case, the cooling flanges can be controlled by means of bimetals, which results in a system that can be utilized for temperature control without the need to utilize the control unit 5.

An additional possibility of reducing the temperature in the exhaust gas treatment unit 18 is to supply cold air, for example from an air pump, into the return chambers 24. Due to the effect of the interchange of heat that is obtained according to the invention, even small amounts of supplied air results in a considerable temperature reduction of the gas flow through the exhaust gas treatment unit 18.

The supplied cold air can be non-compressed or compressed. According to one solution, the supplied air can be constituted by compressed air that is taken from the induction pipe of the engine, preferably after a compressor forming part of a turbo-aggregate. Alternatively, the cold air can be constituted by exhaust gases which are guided out from the exhaust manifold of the engine (before the turbo-aggregate) and which are cooled down, for example, by means of a suitable form of after-treatment.

The main principle for external cooling is to carry off heat from the return chambers 27, 28 essentially without any mass exchange. During air injection, the heat that is present will be diluted and the temperature will drop because of the supply of cold gas into the flow. In both cases, the principle of heat exchange functions as a step-up exchange and results in a considerably enhanced effect as regards the temperature.

By means of an arrangement of the above-mentioned kind, an effective control of the temperature of the gas flow is obtained, so that the gas flow can be controlled and adjusted to a value that is optimally adjusted to the prevailing operating condition. This is particularly achieved by means of the fact that the design of the exhaust gas treatment unit 18 provides a satisfying heat transmission and a catalytic effect by means of a satisfying contact between the flowing gas and the walls in the exhaust gas treatment unit 18.

In order to facilitate the temperature control of the invention, the invention can comprise a (not shown) temperature sensor that is provided in connection with the exhaust gas treatment unit 18. In that case, such a temperature sensor can be connected to the control unit 5 via an electrical connection and delivers a measurement value that corresponds to the prevailing temperature of the exhaust gas treatment unit 18. In that case, the measurement value can be utilized during the control of an increase and a reduction, respectively, of the temperature of the exhaust gas treatment unit 18, according to the methods explained above. In this manner, an accurate control of the temperature of the exhaust gas flow is provided. It is in particular suitable to utilize information regarding the temperature in the respective return chamber 27, 28, but information regarding the temperature in other parts of the exhaust gas treatment unit 18 may also be of interest. In such a case, more than one temperature sensor can be utilized for determining the temperature in a corresponding number of points.

However, it shall be emphasized that the invention is not limited to merely the type of system which comprises such a separate temperature sensor, but the invention can also be realized by letting the control unit 5 include a program with a calculation model that predicts the temperature of the exhaust gas treatment unit 18 during various operating conditions with a satisfying accuracy. Accordingly, one associated aspect of the present invention entails determining a measure of the temperature of said exhaust gas treatment unit by means of calculation models (M) which are defined beforehand and which define a relationship between said temperature and the prevailing operating condition of the engine, wherein said temperature measure is utilized during said control of the temperature.

The invention can be formed in order to prevent clogging of carbon and similar particles in order to provide a high degree of filtration even after some time of use. This can be obtained by means of optimization of various parameters, for example, the geometric design of the exhaust gas treatment unit 18, exemplarily regarding its length, width and height. Furthermore, the form and wave height of the corrugations 20, as well as the distance between two adjacent corrugations, can be adjusted in order to prevent such clogging. In this regard, the control of the engine 1 can also be optimized.

Furthermore, the invention can be optimized in order to provide a lowest possible pressure loss. This can take place by means of an adjustment of the geometric construction of the exhaust gas treatment unit 18, for example, via its length, width and height.

The invention is not limited to the embodiment which is described above and shown in the drawings, but may be varied within the scope of the appended claims. For example, the strip 19*a* can be manufactured by a thin metal plate or foil such as stainless (rustless) steel. This metal plate or foil can be coated with catalytic material as mentioned above. Alternatively, the strip 19*a* can consist of a ceramic material that has exemplarily been impregnated or coated with catalytic material. Furthermore, the material can alternatively be manufactured in the form of thin sheets or similar elements, which in that case are arranged in a package and which are subsequently joined together along the edges so that the above-mentioned strip package 19*a* is formed.

If the exhaust gas treatment unit 18 comprises materials that provide the function of a three-way catalyst and a $NO_x$ adsorbent, these materials can be arranged in various ways. For example, the materials can be situated on various areas along the exhaust gas treatment unit 18. Still further, the inlet part of the exhaust gas treatment unit 18 can function as a three-way catalyst, whereas the inner parts of the exhaust gas treatment unit 18 functions as a $NO_x$ adsorbent. In that case, by means of a suitable design, the above-mentioned pre-catalyst 32 can also be eliminated.

The inlet and the outlet, respectively, of the exhaust gas treatment unit 18 can be positioned according to what has been explained above; that is, essentially centrally on the respective side wall 24*c*, 24*d*. Alternatively, it is possible to position the inlet and the outlet displaced towards either direction along the respective side wall. For example, this displacement can be of such a distance that the inlet will be situated, right up, in one end of the strip package. In such a case, only one return chamber is utilized.

The invention is not limited to utilizations in connection with only diesel engines, but can in principle be applied in all types of combustion processes where particles in the form of, for example, carbon are present in the exhaust gases from engines which at least periodically are operated by a surplus of oxygen.

Generally, the invention is not limited for utilization in connection with motor vehicles, but may be applied in other connections where there is a demand for filtering particles in a gas flow.

What is claimed is:

1. A method for treating a gas flow, comprising:

guiding a gas flow through a gas treatment unit that is adapted for filtering particles from said gas flow thereby eliminating said particles in said gas treatment unit;

filtering particles from said gas flow by accumulating said particles in at least one duct that forms part of said gas treatment unit during passage of said gas flow therethrough;

controlling the temperature of said gas flow along said at least one duct to a value that causes combustion of said particles; and eliminating filtered particles in said gas treatment unit by combustion in said at least one duct, wherein said temperature control of said gas flow takes part by means of exchange of heat between said plurality of ducts, wherein said ducts are connected to an inlet and an outlet of the gas treatment unit so that the gas flow undergoes an exchange of heat between incoming and outgoing flows of said gas.

2. The method as recited in claim 1, wherein said at least one duct further comprises a plurality of ducts.

3. The method as recited in claim 2, wherein said gas flow is constituted by a flow of exhaust gases from a combustion engine and said temperature control of said gas flow takes place by means of at least one of the following group of measures that consists of: i) controlling injection time and ignition sequence of said engine so that an increased exhaust gas temperature is obtained; ii) controlling said engine wherein an additional injection of fuel is made during an exhaust stroke of the engine; iii) controlling said engine periodically between rich and lean operation; iv) injecting air from an external source into said exhaust gas treatment unit during rich operation of said engine; v) controlling cylinders of the engine, individually, in such a manner that exhaust gases from at least one of said cylinders of said engine are operated richly and remaining cylinders are operated leanly or stoichiometricly; vi) supplying heat through a heater element provided at the exhaust gas treatment unit; vii) injecting fuel into said exhaust gases after said engine; and viii) oxidizing uncombusted hydrocarbons in said exhaust gas treatment unit.

4. The method as recited in claim 2, wherein said filtering is accomplished by means of surface filtering in said exhaust gas treatment unit.

5. The method as recited in claim 2, wherein said filtering is accomplished by means of deep filtering in said exhaust gas treatment unit.

6. The method as recited in claim 2, wherein said filtering is accomplished by means of an electric filter, wherein said accumulation of particles takes place on an earthed element in said exhaust gas treatment unit.

7. The method as recited in claim 2, wherein said filtering is made during turbulent flow of said gas thereby causing a mixing of said gas.

8. The method as recited in claim 2, further comprising reducing undesired emissions in said gas flow by means of a catalytic coating in said ducts.

9. The method as recited in claim 8, further comprising reducing NOx compounds in said gas flow by means of said catalytic coating.

10. The method as recited in claim 2, further comprising determining a measure regarding the temperature of said exhaust gas treatment unit by means of at least one separate temperature sensor provided in connection with the exhaust gas treatment unit, wherein said measure is utilized during said control of the temperature.

11. The method as recited in claim 2, further comprising determining a measure of the temperature of said exhaust gas treatment unit by means of calculation models which are defined beforehand and which define a relationship between said temperature and the prevailing operating condition of the engine, wherein said temperature measure is utilized during said control of the temperature.

12. The method as recited in claim 2, wherein said control of the temperature of said gas flow is accomplished by means of a particular control of the composition of said gas flow.

13. A device for treating a gas flow, comprising:

a gas treatment unit adapted for filtering particles in said gas flow and for eliminating said particles, said gas treatment unit being provided with a number of ducts for filtering by means of accumulation of said particles in said ducts during passage of the gas flow through the gas treatment unit; and said gas treatment unit being adapted for controlling the temperature of said gas flow to a value which provides combustion of said particles along said ducts and said ducts being connected to an inlet and to an outlet of the gas treatment unit so that and interchange of heat between incoming and outgoing flows of said gas flow take place.

14. The device for treating a gas flow as recited in claim 13, wherein said exhaust gas treatment unit is adapted for surface filtering of particles.

15. The device for treating a gas flow as recited in claim 13, wherein said exhaust gas treatment unit further comprises a structure for deep filtering of particles.

16. The device for treating a gas flow as recited in claim 13, wherein said exhaust gas treatment unit further comprises an electric filter for ionization of said particles and an earthed element in said exhaust gas treatment unit for eliminating said particles.

17. The device for treating a gas flow as recited in claim 13, wherein said exhaust gas treatment unit is configured to generate a turbulent flow that mixes said gas.

18. The device for treating a gas flow as recited in claim 13, wherein said exhaust gas treatment unit further comprises a catalytic coating in said ducts for reducing undesired emissions in said gas flow.

19. The device for treating a gas flow as recited in claim 13, further comprising at least one temperature sensor that is provided in connection with the exhaust gas treatment unit and is configured to determine temperature of said exhaust gas treatment unit.

20. The device for treating a gas flow as recited in claim 13, wherein said exhaust gas treatment unit further comprises a strip which is folded into a package and by means of which said ducts are formed.

* * * * *